US008920252B2

(12) United States Patent
Kim

(10) Patent No.: US 8,920,252 B2
(45) Date of Patent: Dec. 30, 2014

(54) FRAME STRUCTURE FOR STAGE ERECTION

(75) Inventor: Sang-Wook Kim, Goyang-si (KR)

(73) Assignee: People Ent Co., Ltd., Goyang (KR)

( * ) Notice: Subject to any disclaimer, the term of this patent is extended or adjusted under 35 U.S.C. 154(b) by 136 days.

(21) Appl. No.: 13/812,509

(22) PCT Filed: Aug. 11, 2011

(86) PCT No.: PCT/KR2011/005881
§ 371 (c)(1),
(2), (4) Date: Jan. 26, 2013

(87) PCT Pub. No.: WO2012/023749
PCT Pub. Date: Feb. 23, 2012

(65) Prior Publication Data

US 2013/0143680 A1 Jun. 6, 2013

(30) Foreign Application Priority Data

Aug. 18, 2010 (KR) ..... 10-2010-0079893
May 20, 2011 (KR) ..... 10-2011-0048074

(51) Int. Cl.
*A63J 1/00* (2006.01)
*E04H 3/22* (2006.01)

(52) U.S. Cl.
CPC ..... *A63J 1/00* (2013.01)
USPC ..... 472/75; 52/6

(58) Field of Classification Search
CPC ..... A63J 1/00; A63J 1/02; A63J 5/00; A63J 5/02; A63J 21/00; E04H 3/22; E04H 3/24; E04H 3/26; E04H 3/28; E04H 3/126
USPC ..... 472/75–81; 52/6, 7
See application file for complete search history.

(56) References Cited

U.S. PATENT DOCUMENTS 2,369,340 A * 2/1945 Ditty et al. ..... 52/7
2,846,221 A * 8/1958 Skinner ..... 472/75
4,512,117 A * 4/1985 Lange ..... 52/6
4,863,126 A * 9/1989 Rogers et al. ..... 248/158
5,205,101 A * 4/1993 Swan et al. ..... 52/650.1
6,004,182 A * 12/1999 Pasin ..... 446/105

FOREIGN PATENT DOCUMENTS

JP 10-109586 A 4/1998
KR 10-1999-0029219 A 4/1999
KR 10-2008-0099792 A 11/2008
KR 10-2009-0055735 A 6/2009

OTHER PUBLICATIONS

International Search Report of PCT/KR2011/005881.

* cited by examiner

*Primary Examiner* — Kien Nguyen
(74) *Attorney, Agent, or Firm* — Maxon IP, LLC; Justin H. Kim

(57) ABSTRACT

A frame structure for stage erection comprises a plurality of support frames and a bridge. The support frames are disposed parallel to each other, and respectively have rail recesses formed in the length direction in facing locations. The bridge connects across the support frames so as to maintain a mutually parallel state, and has a rail-joining part for fastening to and separating from the rail recesses in at least one of the two end locations.

20 Claims, 12 Drawing Sheets

FRAME STRUCTURE FOR STAGE ERECTION

TECHNICAL FIELD

The present invention relates to a frame structure for erection of a stage, and more particularly, to a frame structure constructed on a stage in order to construct supplementary installations, such as lights and billboards, on a stage.

BACKGROUND ART

In general, in places for progressing various events or performances, such as theaters, auditoriums, concert halls or exhibition halls, in order to enhance effects of the events or performances, a frame structure is constructed above a stage and supplementary installations such as lights and billboards are installed on the frame structure.

Here, the frame structure is a modular frame structure which includes three or four frames opposed to each other and a plurality of bridges for connecting the frames with each other, and the modular frame structure can be constructed in various forms by users. Here, the bridge may be a truss which is generally used for the frame structure.

However, in the case that the place for events or performances is out of doors or is far away from a storage site where the modular frame structures are stored, it is necessary to transport the modular frame structures from the storage site. In this instance, each of the modular frame structures are stored in a state where the bridges are welded to the support frames when the modular frame structures are stored in the storage site.

Therefore, in the case that the modular frame structures are transported from the storage site to the place where the stage is constructed, it may be difficult to transport the modular frame structures because the modular frame structures are bulky due to the welded bridges.

DISCLOSURE

Technical Problem

Accordingly, the present invention has been made in an effort to solve the above-mentioned problems occurring in the prior arts, and it is an object of the present invention to provide a frame structure which can provide convenience in transporting support frames and bridges for connecting the support frames with each other.

Technical Solution

To achieve the above objects, the present invention provides a frame structure for stage erection including a plurality of support frames and a plurality of bridges.

The support frames are disposed parallel to each other, and each of the support frames has a rail recess formed in a length direction at a portion where they are opposed to each other. The bridges are connected between the support frames to keep the parallel state of the support frames, and each of the bridges has a rail-joining part which is formed on at least one of both end portions thereof and is joined to or separated from the rail recess.

Here, the rail recess has an inner width greater than that of an entrance where the support frames are opposed to each other, and the rail-joining part has a retaining portion inserted into the rail recess to be caught to the entrance.

In this instance, each of the support frames has a fixing hole formed at a predetermined position of the rail recess to fix the retaining portion.

In the meantime, the frame structure further includes a fixing member inserted into the fixing hole for fixing the retaining portion. Concretely, the fixing member includes a bolt which is inserted into the fixing hole from a position of the fixing hole opposed to the retaining portion to pressurize the first retaining portion or is removed from the fixing hole. Differently from the above, the fixing member may include a fixture inserted into the fixing hole by elasticity of an elastic body, which is inserted into a portion of the retaining portion opposed to the fixing hole in order to provide elasticity to a direction of the fixing hole.

Moreover, the frame structure may further include a separation member for pushing the fixture at a position of the fixture opposed to the retaining portion to thereby separate the fixture from the fixing hole.

In the meantime, the bridge may further include a body part hinge-coupled with the rail-joining part between the support frames. The body part has a telescopic structure to change the length of the body part when an interval between the support frames is changed and comprises a fixing part disposed at a length-changeable portion in order to fix the longest state or the shortest state.

In order to achieve the above object, in another aspect of the present invention, the present invention provides a frame structure for stage erection including a plurality of support frames and a plurality of bridges. The support frames are disposed parallel to each other. Each of the bridges has a hinge-coupling structure at both end portions thereof and is joined to connect the support frames with each other, and also has a telescopic structure to change the length of the bridge when an interval between the support frames is changed.

In this instance, the bridge includes a fixing part disposed at a length-changeable portion in order to fix the longest state or the shortest state.

The frame structure further includes a lever mounted on at least one of the support frames to release the fixing part.

In the meantime, the frame structure further includes a second bridge connected between the support frames, the second bridge being hinge-coupled to one of the support frames and having a structure to be joined to and separated from another one of the support frames.

Advantageous Effects

In the frame structure for stage erection according to the present invention, the support frames disposed parallel to each other respectively have the rail recesses and the bridges are respectively inserted and joined into the entrance of the rail recess not to be separated from the rail recess in a state where the bridges are respectively separated from the support frames. Accordingly, in the case that the stage is constructed outdoors far away from a storage site where the frame structures are stored, the support frames and the bridges can be transported in the separated state.

Accordingly, because the frame structure can be reduced in volume so that workers can easily transport the frame structures, the frame structure according to the present invention can reduce the size of vehicles and the number of workers necessary for transport and also reduce transport expenses.

Moreover, because the bridges for connecting the support frames with each other have the telescopic structure to change the length of the bridges, the intervals between the support frames can be narrowed in a state where the bridges are connected to the support frames, and hence, the frame structure can be reduced in volume and can reduce the transport expenses.

MODE FOR INVENTION

Figure 1:
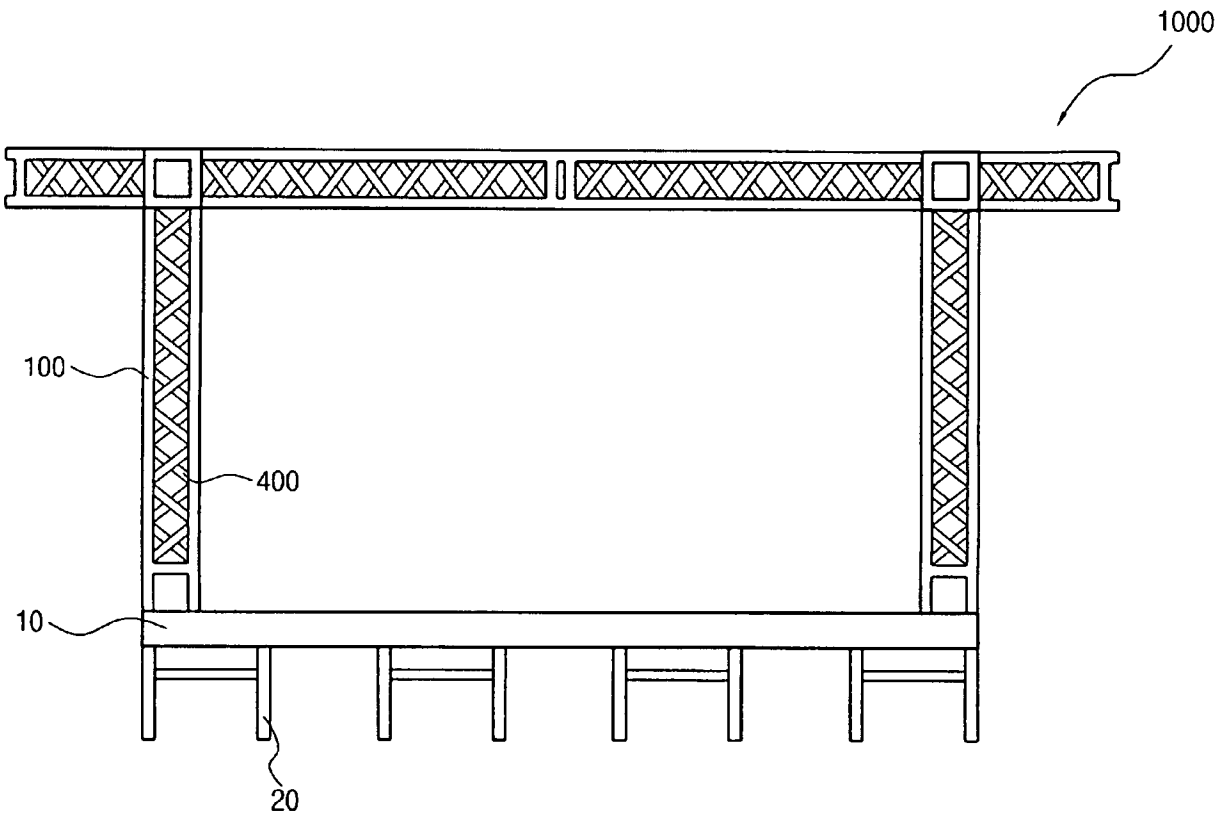
FIG. 1 is a schematic diagram of a frame structure for stage erection according to a preferred embodiment of the present invention.

With reference to the attached drawings, example embodiments of a frame structure for stage erection according to the present invention will herein be described in detail. The example embodiments of the present invention are capable of various modifications and alternative forms, and particular embodiments of the present invention will be illustrated in the attached drawings and described in this specification in detail. It should be understood, however, that there is no intent to limit example embodiments of the invention to the particular forms disclosed, but on the contrary, example embodiments of the invention are to cover all modifications, equivalents, and alternatives falling within the technical idea and scope of the present invention. In the attached drawings, similar components have similar reference numerals even though they are illustrated in different figures. Additionally, in the attached drawings, dimensions of the components are more enlarged than they actually are in order to clarify the present invention.

It will be understood that terms, such as "first" or "second" may be used in the specification to describe various components but are not restricted to the above terms. The terms may be used to discriminate one component from another component. For instance, the first component may be named as the second component, and on the contrary, the second component may be also named as the first component within the scope of the present invention.

It will be further understood that the words or terms used in the present invention are used to describe specific embodiments of the present invention and there is no intent to limit the present invention. The singular form of the components may be understood into the plural form unless otherwise specifically stated in the context. It should be also understood that the terms of 'include' or 'have' in the specification are used to mean that there are characteristics, numbers, steps, operations, components, parts, or combinations of the steps, operations, components and parts described in the specification and there is no intent to exclude existence or possibility of other characteristics, numbers, steps, operations, components, parts, or combinations of the steps, operations, components and parts.

In the meantime, not otherwise particularly defined, it will be understood that all terms used in the specification including technical or scientific terms has the same meanings as to be generally or commonly understood by those of ordinary skill in the art. It will be further understood that words or terms described as the meaning defined in commonly used dictionaries shall be interpreted as having meanings that are consistent with their meanings in the context of the relevant art and the technical idea of the invention, and shall not be interpreted as having ideal meanings or excessively formal meanings, not otherwise particularly stated.

Figure 2:
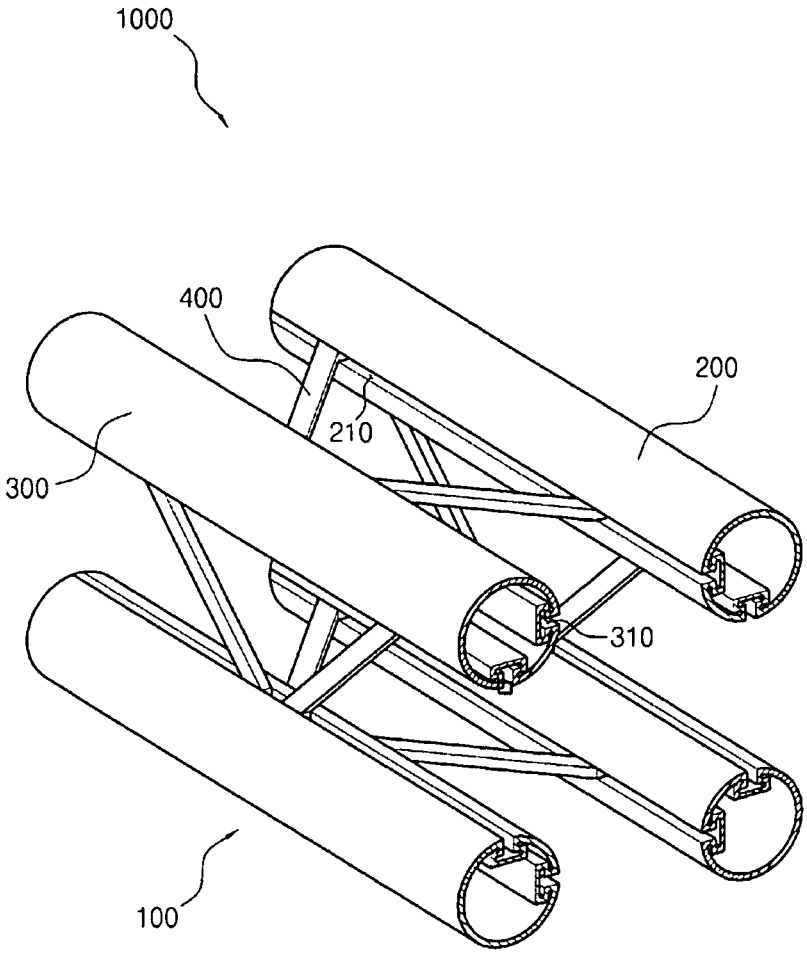
FIG. 2 is a partially enlarged perspective view of the frame structure of FIG. 1.

FIG. 1 is a schematic diagram of a frame structure for stage erection according to a preferred embodiment of the present invention, and FIG. 2 is a partially enlarged perspective view of the frame structure of FIG. 1.

Referring to FIGS. 1 and 2, the frame structure 100 according to a preferred embodiment of the present invention includes a plurality of support frames 100 and a plurality of bridges 400.

The support frames 100 are installed parallel to each other above a stage 10, such as theaters, auditoriums, concert halls or exhibition halls, constructed in order to progress various performances or events. Here, differently from the stage 10 constructed in the exhibition hall, the stage 10 constructed in the theaters, auditoriums, or concert halls may be constructed at a specific height using a bridge 20 as shown in FIG. 1 in order to let persons see the performances or events. In this instance, the bridge 20 may be installed in the same structure as the frame structure 1000 (2000 in FIG. 9) which will be described in detail in various embodiments hereinafter. Accordingly, the bridge 20 may also provide the same effects as the frame structure 1000 (2000 in FIG. 9).

Supplementary installations, such as lights and billboards, may be mounted on the support frames 100 in order to enhance effects of the events or performances. For this, the support frames 100 may be installed at both sides of the stage 10 in a pillar structure and be installed at upper portions of the support frames 100 of the pillar structure in a ceiling structure. Differently, the support frames 100 may be installed on the stage 10 in various structures according to kinds of the events or performances.

The bridges 400 connect the support frames 100 with each other in order to keep the support frames 100 in a parallel state. In an aspect of structure, the bridge 400 may be named as a truss commonly used in the frame structure.

The bridges 400 may more firmly connect the support frames 100 at regular intervals in a zigzag form. Moreover, the bridges 400 may have a curved structure.

Furthermore, as shown in FIG. 2, the bridges 400 may connect four support frames 100 with one another. Then, the four support frames 100 become one unit structure having a rectangular cross section, and the rectangular unit structures may be installed on the stage 10.

Differently from the above, the bridges 400 may connect not four but at least three support frames 100 with one another into one unit structure having a polygonal cross section. Additionally, the bridges 400 can connect at least two support frames 100 to have an "L"-shaped cross section or a bent structure that several parts are bent in various forms.

Hereinafter, referring to FIG. 3, a detailed structure of the bridges 400 to connect the support frames 100 with each other will be described in more detail.

Figure 3:
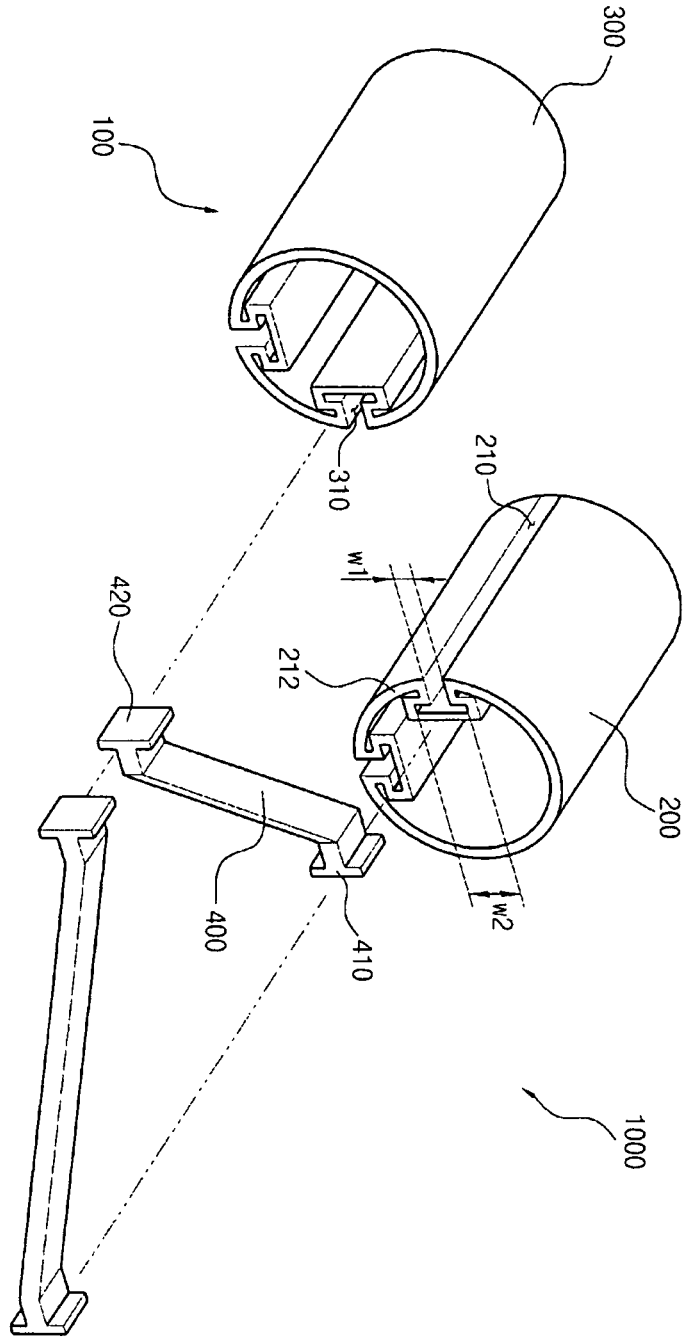
FIG. 3 is an exploded view of first and second support frames and bridges of the frame structure of FIG. 2.

FIG. 3 is an exploded view of first and second support frames and bridges of the frame structure of FIG. 2.

Referring to FIG. 3, first and second frames 200 and 300 of the support frames 100, which are adjacent and parallel to each other, respectively have first and second rail recesses 210 and 310 respectively formed at opposed portions thereof. Here, the first and second rail recesses 210 and 310 are elongated in parallel to each other along length directions of the first and second support frames 200 and 300.

The first rail recess 210 has an inner width (w2) greater than a width (w1) of an entrance opposed to the second rail recess 310. For instance, the first rail recess 210 may have a "T" or "L" shaped cross section. Moreover, the first rail recess 210 is exposed to the outside from an end portion 212 of the first support frame 200.

Hereinafter, the second rail recess 310 has the same structure as the first rail recess 210 except that the second rail recess 310 is elongated in parallel with the first rail recess 210, and hence, its detailed description will be omitted. In addition, it is considered that the second rail recess 310 has the same structure as the first rail recess 210 which will be described later.

The bridge 400 includes first and second retaining portions 410 and 420 formed at both end portions thereof and respectively inserted and joined to the first and second rail recesses 210 and 310.

The first retaining portion 410 is inserted into the first rail recess 210 in such a way as to be caught to an entrance of the first rail recess 210. The first retaining portion 410 may have a cross section identical with that of the first rail recess 210. Accordingly, the bridge 400 is formed in such a fashion that the first retaining portion 410 is inserted from the exposed end portion 212 of the first rail recess 210 and caught to the entrance of the first rail recess 210.

In this instance, a portion of the first retaining portion 410 which meets with the entrance of the first rail recess 210 may have a width identical with the width (w1) of the entrance. The reason is to prevent that the bridge 400 is vibrated in a vertical direction to the first rail recess 210.

Hereinafter, except the structure that the second retaining portion 420 is inserted and joined to the second rail recess 310, because the second retaining portion 420 is equal to the first retaining portion 410, its detailed description will be omitted. Moreover, it is considered that the second retaining portion 420 also has the same structure as the first retaining portion 410 which will be described later.

As described above, because the first and second retaining portions 41 and 420 are respectively inserted and joined to the first and second rail recesses 210 and 310 in such a way as not to fall out in a state where the bridges 400 are separated from the first and second support frames 200 and 300, in the case that the stage 10 is constructed outdoors far away from a storage site, the first and second support frames 200 and 300 and the bridges 400 may be transported in a separated state.

Therefore, the frame structure according to the present invention can be reduced in volume to facilitate transport, and hence, it can decrease the size of a vehicle necessary for transport and the number of workers. So, the frame structure 1000 according to the present invention can reduce transporting costs.

Moreover, the first and second support frames 200 and 300 respectively include a plurality of support rods (not shown in the drawings) mounted therein in a shape of a honeycomb in order to reinforce intensity, so that the frame structure 1000 can have a more stable structure. Therefore, in order to reinforce intensity, the bridges 400 also may be formed in the shape of the honeycomb, namely, in a form that has pores therein.

Hereinafter, referring to FIGS. 4 to 6, a structure to fix the first retaining portion 410 of the bridge 400 inserted into the first rail recess 210 of the first support frame 200 will be described in more detail.

Figure 4:
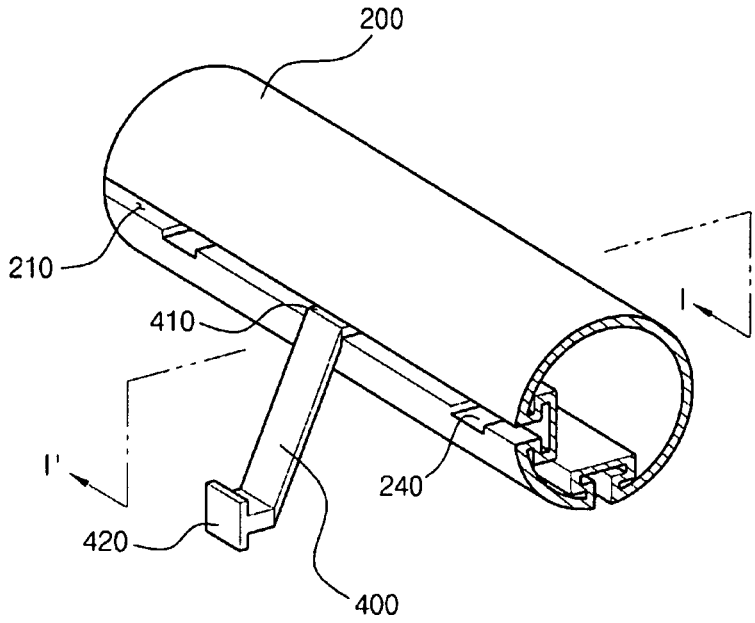
FIG. 4 is a view showing a structure that the bridge is joined to the first support frame of FIG. 3.
Figure 5:
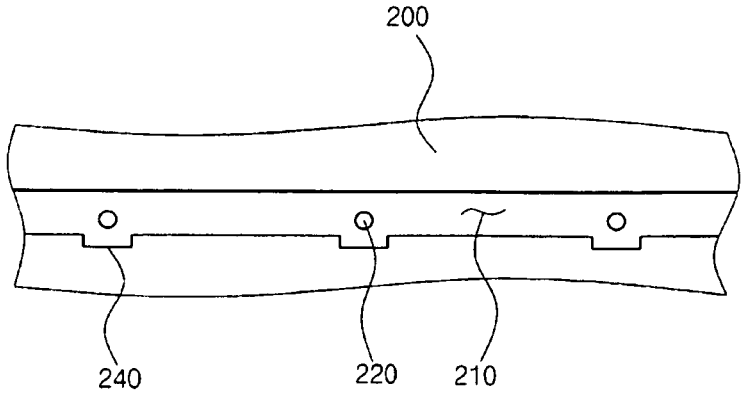
FIG. 5 is a side view of the first support frame of FIG. 4.
Figure 6:
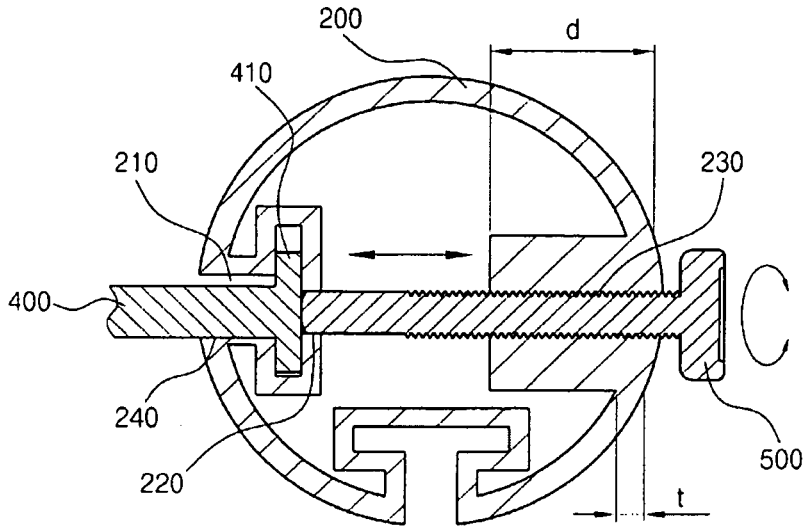
FIG. 6 is a sectional view of an example of a fixing member taken along the line of I-I' of FIG. 4.

FIG. 4 is a view showing a structure that the bridge is joined to the first support frame of FIG. 3, FIG. 5 is a side view of the first support frame of FIG. 4, and FIG. 6 is a sectional view of an example of a fixing member taken along the line of I-I' of FIG. 4.

Referring to FIGS. 4 to 6, the first support frame 200 may have a fixing hole 220 formed at a position where the first retaining portion 410 of the first rail recess 210 will be fixed.

As shown in FIG. 5, the fixing hole 220 is formed at the rear face inside the first rail recess 210 in such a way as to be viewed when the first rail recess 210 is viewed from the side. As shown in FIG. 2, because the bridges 400 are connected to the first and second support frames 200 and 300 at regular intervals, a plurality of the fixing holes 220 may be formed at regular intervals.

Accordingly, the frame structure 1000 may further include a fixing member 500 for fixing the first retaining portion 410 of the truss 400 which is slidably inserted into the fixing hole 220 of the first rail recess 210.

The fixing member 500 may be a bolt which is inserted into the fixing hole 220 from a position of the fixing hole 220 opposed to the first retaining portion 410 to pressurize the first retaining portion 410 or is removed from the fixing hole 220. Here, the bolt is the fixing member 500 in this embodiment, and hence, has the same reference numeral as the fixing member hereinafter.

The first support frame 200 includes a screw hole 230, to which the bolt 500 is inserted at an opposite portion of the first retaining portion 410, and, which has a helical thread formed in the opposite direction to that of the bolt 500.

In this instance, a depth (d) of the screw hole 230 may be greater than a thickness (t) of the first support frame 200 so that the bolt 500 moves stably. For instance, a nut having the screw hole 230 may be mounted at a portion of the first support frame 200, in which the bolt 500 is inserted, by welding.

Accordingly, the first retaining portion 410 of the bridge 400 is pressed and fixed to the position where the fixing hole 220 of the first rail recess 210 is formed through the bolt 500 rotating in the first direction, or is slidably separated out along the first rail recess 210 through the bolt 500 rotating in the second direction opposed to the first direction. In this instance, the bolt 500 may be a butterfly bolt or a bolt having an uneven outer circumferential surface so that a worker can easily rotates it.

In this embodiment, the bolt 500 is inserted into the opposed portion of the first retaining portion 410 to pressurize the first retaining portion 410. However, the bolt 500 may be inserted into a hole (not shown in the drawings) formed in the first retaining portion 410 and is screw-coupled to the fixing hole 220. In this instance, the first support frame 200 may further include a second fixing hole (not shown) formed inside the first support frame 200 and screw-coupled with the bolt 500 so as to stably support the bolt 500 inserted into the fixing hole 220 and an extension pipe (not shown) extending to the inside of the first support frame 200.

In the meantime, the first support frame 200 may further include a guide portion 240 formed at the entrance of the first rail recess 210, in which the fixing hole 220 is formed, so that the first retaining portion 410 slidably inserted along the first rail recess 210 is correctly located at the position of the fixing hole 220.

The reason is that the fixing hole 220 which is formed on the rear face inside the first rail recess 210 is not visible from the outside well. In other words, when the first retaining portion 410 of the bridge 400 is inserted into the first rail recess 210 along the guide portion 240, the first retaining portion 410 can be naturally guided to the fixing hole 220.

As shown in FIGS. 4 and 5, the guide portion 240 may be stepped down from its periphery at the entrance of the first rail recess 210. Such a guide portion 240 may be lower than its periphery into a size that the first retaining portion 410 can be caught to.

Then, the first retaining portion 410 of the bridge 400 is caught to the stepped form of the guide portion 240 to thereby be easily guided to the fixing hole 220. Differently from the above, the guide portion 240 may have a color, a groove or a protrusion as distinguished from its periphery at the entrance of the rail recess 210 to thereby guide the position of the fixing hole 220.

Hereinafter, referring to FIGS. 7 and 8, another example of the fixing member 500 will be described.

Figure 7:
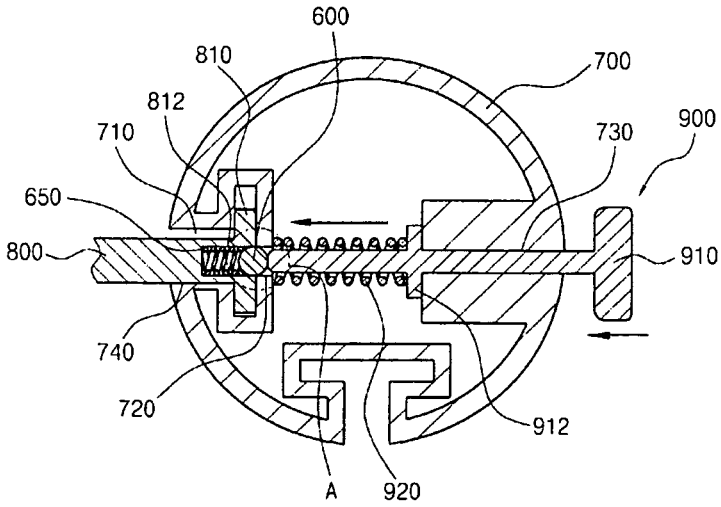
FIG. 7 is a sectional view of another example of the fixing member taken along the line of I-I' of FIG. 4.
Figure 8:
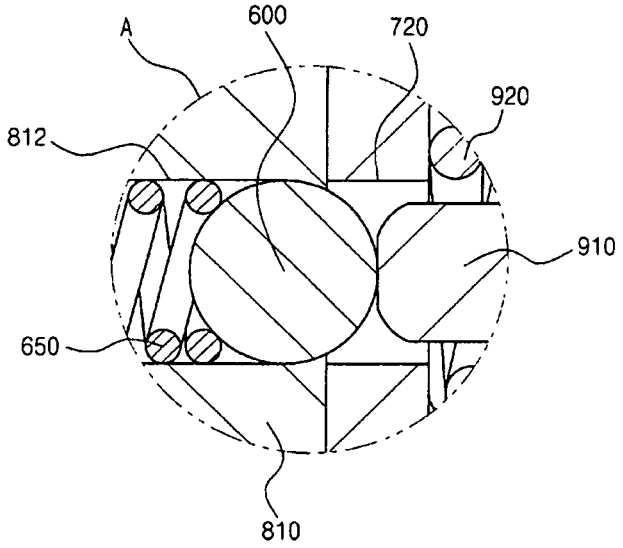
FIG. 8 is an enlarged view of an "A" part of FIG. 7.

FIG. 7 is a sectional view of another example of the fixing member taken along the line of I-I' of FIG. 4, and FIG. 8 is an enlarged view of an "A" part of FIG. 7.

In this embodiment, except that the fixing member 600 fixes the first retaining portion of the bridge, because the fixing member has the same structure as the fixing member illustrated in FIGS. 4 to 6, the same components have the same reference numerals, and the repeated description thereof will be omitted.

Referring to FIGS. 7 and 8, the fixing member 600 includes a fixture inserted into the fixing hole 720 by elasticity of an elastic body 650, which is inserted into a portion of the first retaining portion 810 opposed to a fixing hole 720 in order to provide elasticity to a direction of the fixing hole 720. Here, because the fixture is the fixing member 600 of this embodiment, the fixture has the same reference numeral as the fixing member hereinafter. Furthermore, the elastic body 650 may be, for instance, a compression spring.

In detail, an insertion hole 812 of a predetermined depth is formed at a portion where the fixing member 600 is opposed to the fixing hole 720 of the first retaining portion 810, and then, the elastic body 650 and the fixture 600 are inserted into the insertion hole 812 in order. In this instance, it is preferable that an entrance of the insertion hole 812 is smaller than the diameter of the fixture 600 so that the fixture 600 does not get out of the insertion hole 812 by the elastic body 650.

In this case, because it is difficult to insert the fixture 600 into the insertion hole 812, the fixture 600 is inserted, and then, a band-type member (not shown) may be additionally joined to the entrance of the insertion hole 812 to prevent a separation of the fixture 600.

The fixture 600 is inserted more into the insertion hole 812 by compression of the elastic body 650 when a first retaining portion 810 slides along a first rail recess 710 of a first support frame 700, and then, when the fixture meets the fixing hole 720, it is inserted into the fixing hole 720 by elasticity of the elastic body 650 and fixes the first retaining portion 810 to the fixing hole 720.

As described above, when the first retaining portion 810 of the bridge 800 through the fixture 600 inserted into the fixing hole 720 by elasticity of the elastic body 650 is fixed to the fixing hole 720 of the first rail recess 710, the first retaining portion 810 can be naturally fixed to the fixing hole 720 even though there is no guide portion 740 for guiding the position of the fixing hole 720.

Additionally, in the above case, the frame structure 1000 may further include a separation member 900 for separating the fixture 600 from the fixing hole 720. The separation member 900 pushes the fixture 600 at the opposite position of the first retaining portion 810 of the fixture 600 to thereby separate the fixture 600 from the fixing hole 720.

The separation member 900 may include: a pusher 910 passing through a through hole 730 of the first support frame 700 and pushing the fixture 600 at the opposite position of the fixture 600; and a second elastic body 920 mounted between the fixing hole 720 and the through hole 730 inside the first support frame 700 for providing elasticity to the pusher 910 in a direction to be apart from the fixing hole 720.

Here, the second elastic body 920 may be, for instance, a compression spring surrounding the pusher 910. In this instance, in order to receive the elasticity of the second elastic body 920, the pusher 910 may include a protrusion 912 formed between the through hole 730 and the second elastic body 920 to block the elasticity of the second elastic body 920.

Therefore, when a power to push the fixture 600 is applied from the outside, while the second elastic body 920 is compressed, the pusher 910 moves to the fixing hole 720 to separate the fixture 600 from the fixing hole 720. On the contrary, when the power to push the fixture 600 is removed, the pusher 910 moves to a position where it does not push the fixture 600 by the elasticity of the second elastic body 920. In this instance, in the case of the first support frame 700, a portion where the through hole 730 is formed may be thicker than its periphery so that the pusher 910 can be moved in stability.

Accordingly, when the pusher 910 of the separation member 900 pushes the first retaining portion 810 fixed to the fixing hole 720 in a one-touch manner, so that the first retaining portion 810 can be separated from the first rail recess 810 more simply.

Figure 9:
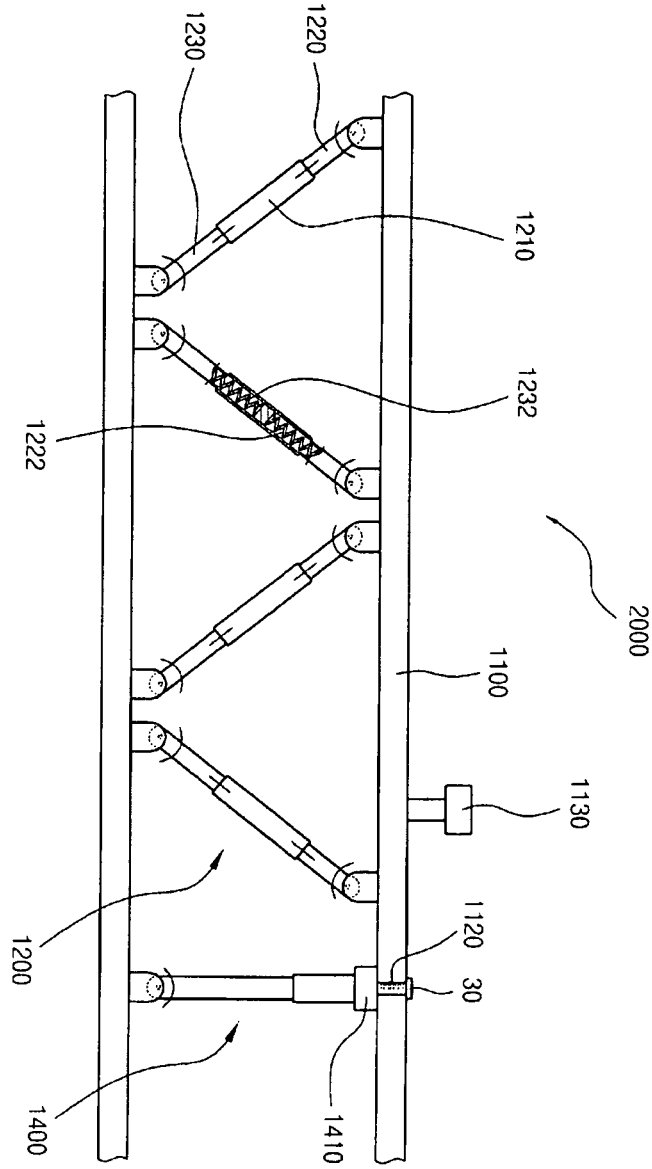
FIG. 9 is a view of a frame structure according to another preferred embodiment of the present invention.
Figure 10:
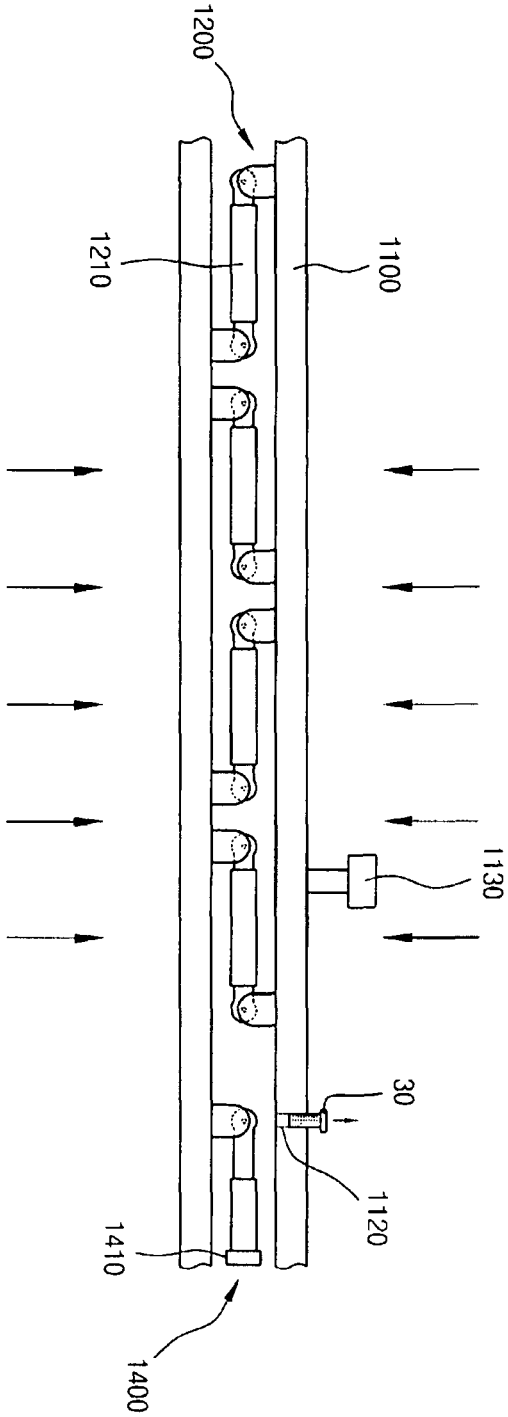
FIG. 10 is a view showing a state where an interval between support frames of the frame structure of FIG. 9 becomes narrowed.

FIG. 9 is a view of a frame structure according to another preferred embodiment of the present invention, and FIG. 10 is a view showing a state where an interval between support frames of the frame structure of FIG. 9 becomes narrowed.

Referring to FIGS. 9 and 10, the frame structure 2000 for stage erection according to another preferred embodiment of the present invention includes a plurality of support frames 1100, a plurality of first bridges 1200, and at least one second bridge 1400.

The support frames 1100 are arranged parallel with each other. The first bridges 1200 connect the support frames 1100 with each other to keep the support frames 1100 in parallel.

The first bridges 1200 can inclinedly connect the support frames 100 with each other in a zigzag form. Moreover, the first bridges 1200 can connect four support frames 1100 with one another.

The first bridges 1200 are connected between the support frames 1100 in a collapsible manner, namely, to narrow and widen an interval between the support frames 1100. For this, the first bridges 1200 respectively have a telescopic body to be changed in length when the intervals among the support frames 1100 are changed, and both ends of each of the first bridges 1200 respectively are hinge-coupled to the support frames 1100.

Figure 11:
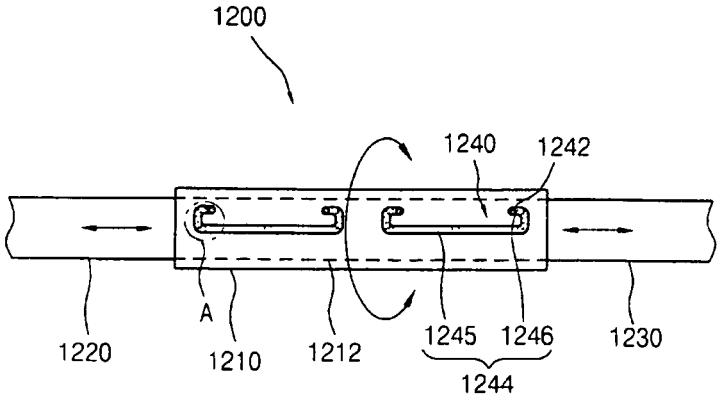
FIG. 11 is a view showing an example of a first bridge of the frame structure of FIG. 9.
Figure 12:
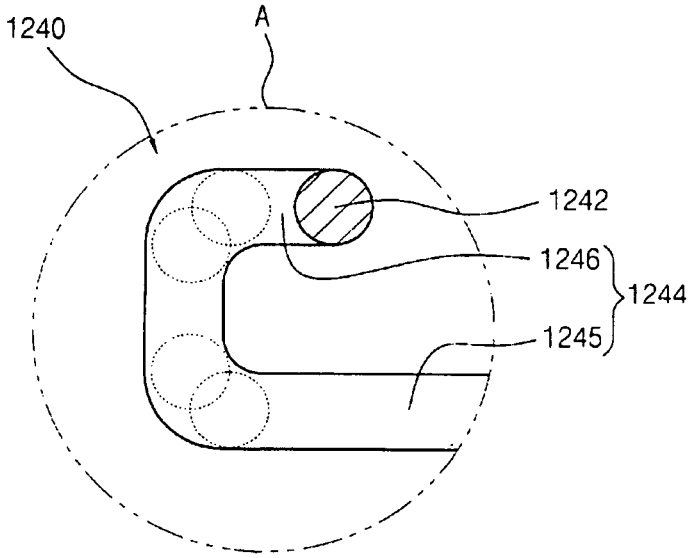
FIG. 12 is an enlarged view of an "A" part of FIG. 11.

Hereinafter, referring to FIGS. 11 to 15, the telescopic structure of the first bridge 1200 to change the length of the first bridge will be described in more detail FIG. 11 is a view showing an example of a first bridge of the frame structure of FIG. 9, and FIG. 12 is an enlarged view of an "A" part of FIG. 11.

Referring to FIGS. 11 and 12, the first bridge 1200 includes a main shaft 1210, a first sub shaft 1220, a second sub shaft 1230, and a fixing part 1240.

The main shaft 1210 has a pipe structure that has a through hole 1212 formed in the middle thereof. The first and second sub shafts 1220 and 1230 are respectively inserted into the through hole 1212 at both ends of the main shaft 1210. So, the first bridge 1200 can be changed in length according to how deep the first and second sub shafts 1220 and 1230 are inserted into the through hole 1212. The first and second sub shafts 1220 and 1230 may respectively have the pipe structure.

In this instance, between the main shaft 1210 and the first and second sub shafts 1220 and 1230, a retaining structure to prevent the first and second sub shafts 1220 and 1230 inserted into the through hole 1212 from being separated from the through hole 1212, for instance, the same structure as the fixing part 1240, may be formed. Furthermore, on the inner face of the through hole 1212 of the main shaft 1210, a structure like an LM bearing may be formed in order to let the first and second sub shafts 1220 and 1230 move smoothly.

The fixing part 1240 can keep a state where the interval between the support frames 1100 is widened as it is by fixing the longest length of the first bridge 1200. Additionally, as described above, the fixing part 1240 can prevent the first and second sub shafts 1220 and 1230 from being separated from the through hole 1212.

The fixing part 1240 is formed at a portion where the main shaft 1210 and the first and second sub shafts 1220 and 1230 meet with each other. Concretely, the fixing part 1240 may include: fixing protrusions 1242 respectively formed on the first and second sub shafts 1220 and 1230; and a guide groove 1244 formed to movably insert the fixing protrusion 1242 into the main shaft 1210.

Accordingly, the guide groove 1244 includes: a first groove portion 1245 formed in a longitudinal direction of the main shaft 1210 to change lengths of the first and second sub shafts 1220 and 1230; and a second groove portion 1246 from in a hook shape from the outside end portion of the first groove portion 1245 for fixing the fixing protrusion 1242.

When the fixing protrusion 1242 is located at the outside end portion of the first groove portion 1245 so that the first and second sub shafts 1220 and 1230 are in the longest state, the main shaft 1210 is rotated to thereby fix the fixing protrusion 1242 to the second groove portion 1246, so that the first bridge 1200 can be fixed in the longest state.

In this embodiment, the fixing protrusions 1242 are respectively formed on the first and second sub shafts 1220 and 1230 and the guide groove 1244 is formed in the main shaft 1210, but they may be formed vice versa.

Meanwhile, the structure to fix the fixing part 1240 may be formed at a portion where the main shaft 1210 and the first and second sub shafts 1220 and 1230 meet with each other in the same way, so that the first bridge 1200 is fixed in the shortest state to thereby keep the collapsed state of the support frames 1100 as they are.

Moreover, the frame structure 2000 may further include a lever 1130 for releasing the fixing part 1240. That is, when the lever 1130 is operated, the main shaft 1210 is rotated, and then, the fixing part 1240 is released. In this instance, the lever 1130 can be connected to a plurality of the main shafts 1210 through power transmission means, such as a wire or a connection gear.

In order to automatically widen the intervals between the support frames 1100 when the fixing part 1240 to fix the longest state or the shortest state is released by the lever 1240, the first bridge 1200 may further include first and second springs 1222 and 1232 formed inside the through hole 1212 between the main shaft 1210 and the first and second sub shafts 1220 and 1230.

Concretely, the first and second springs 1222 and 1232 are respectively mounted in the through hole 1212 to provide elasticity to the first and second sub shafts 1220 and 1230 in a direction to be apart from the main shaft 1210, so that the interval between the support frames 1100 is automatically widened by a releasing action of the lever 1130. Differently from the above, the first and second springs 1222 and 1232 may be respectively mounted to provide elasticity to the first and second sub shafts 1220 and 1230 in a direction to move toward the main shaft 1210, so that the interval between the support frames 1100 is automatically narrowed by the releasing action of the lever 1130.

Figure 13:
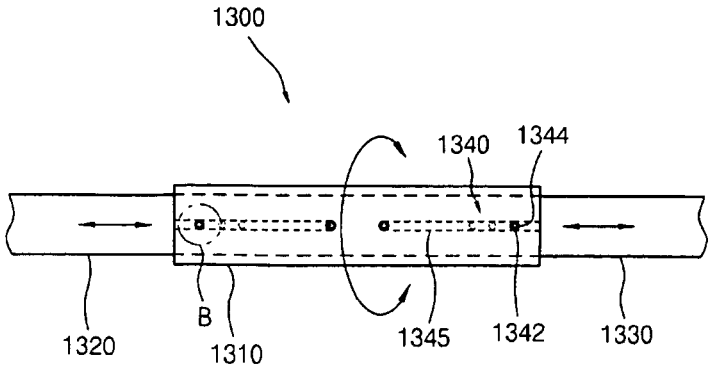
FIG. 13 is a view showing another example of the first bridge of the frame structure of FIG. 9.
Figure 14:
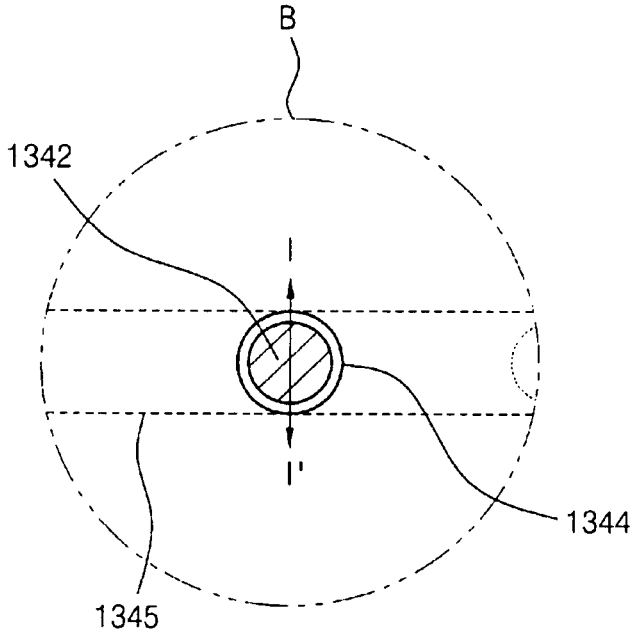
FIG. 14 is an enlarged view of a "B" part of FIG. 13.
Figure 15:
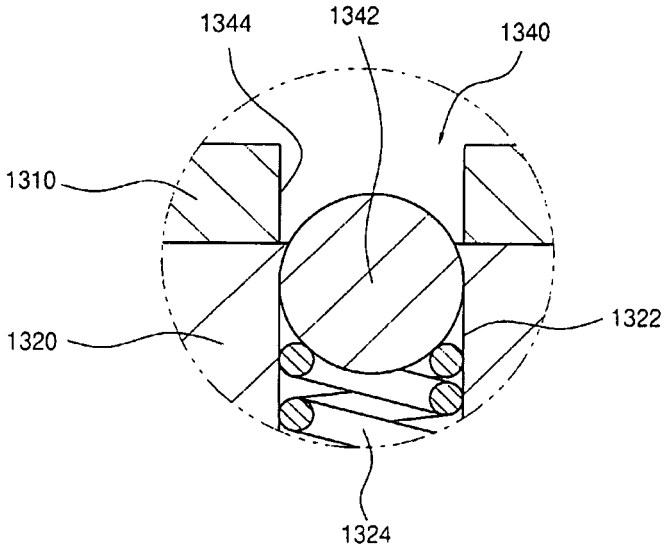
FIG. 15 is a sectional view taken along the line of I-I' of FIG. 14.

FIG. 13 is a view showing another example of the first bridge of the frame structure of FIG. 9, FIG. 14 is an enlarged view of a "B" part of FIG. 13, and FIG. 15 is a sectional view taken along the line of I-I' of FIG. 14.

In this embodiment, the first bridge is equal to the first bridge illustrated in FIG. 11 excepting the fixing part, and hence, the same components have the same reference numerals as the above embodiment, and the repeated description will be omitted.

Referring to FIGS. 13 to 15, a fixing part 1340 of the first bridge 1300 includes fixing balls 1342 respectively formed on first and second sub shafts 1320 and 1330 and a fixing hole 1344 formed in a main shaft 1310 for inserting and fixing the fixing balls 1342 thereinto.

The fixing balls 1342 are respectively disposed on an elastic body 1324 such as a compression spring inside an insertion hole 1322 formed in outer faces of the first and second sub shafts 1320 and 1330. So, the fixing ball 1342 goes into the insertion hole 1322 when an external force is applied, but protrudes from the insertion hole 1322 by the elastic body 1324 when the external force is removed.

The fixing hole 1344 is formed in correspondence with the position of the fixing ball 1342 in the longest state of the first and second sub shafts 1320 and 1330. Therefore, the fixing ball 1342 is inserted into the insertion hole 1322 by the inner face of the main shaft 1310 at positions of the first and second sub shafts 1320 and 1330 deviated from the fixing hole 1344, but protrudes from the insertion hole 1322 to the fixing hole 1344 when the first and second sub shafts 1320 and 1330 meet with the fixing hole 1344 in the longest state, so that the first bridge 1300 can be fixed in the longest state. In this instance, the main shaft 1310 may has a guide portion 1345 formed on the inner face thereof for guiding the fixing ball 1344 to the fixing hole 1344.

In the meantime, the fixing structure of the fixing part 1340 may be formed at a portion that the main shaft 1310 and the first and second sub shafts 1320 and 1330 meet with each other in the same way, so that the first bridge 1300 is fixed in the shortest state to keep the state where the interval between the support frames 1100 (in FIG. 9) is minimized.

Additionally, the fixing part 1340 of this embodiment may be released by being connected to the lever of FIG. 2 (1130 of FIG. 9). Concretely, the fixing part 1340 may be released when the fixing ball 1344 is inserted into the insertion hole 1322 by the action of the lever 1130 (in FIG. 9). In this instance, like the description referring to FIGS. 11 and 12, the interval between the support frames 1100 in FIG. 9) can be automatically widened or narrowed through the lever 1130 (in FIG. 9) and the first and second springs 1222 and 1232 (in FIG. 9).

Hereinafter, referring to FIG. 16, a structure that both end portions of the first bridge 1300 are respectively hinge-coupled to the support frames 1199 will be described in more detail.

Figure 16:
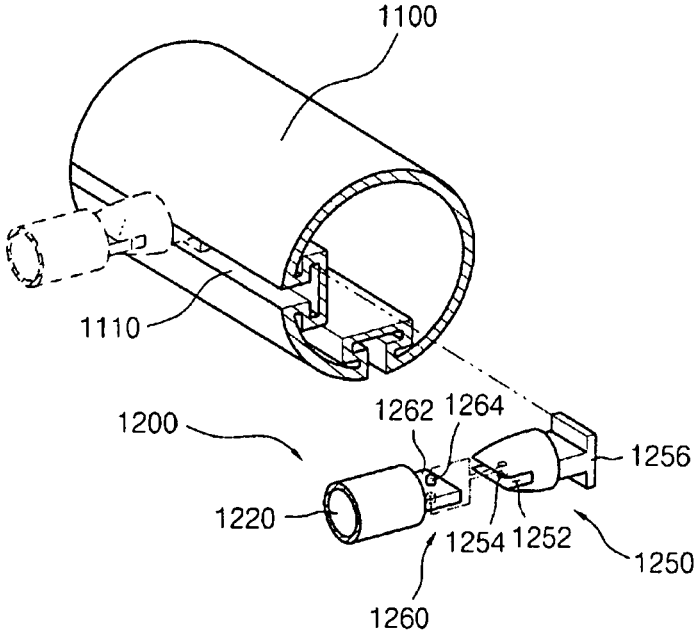
FIG. 16 is an exploded perspective view showing a state where the support frames and the first bridge of the frame structure of FIG. 9 are separated from one another.

FIG. 16 is an exploded perspective view showing a state where the support frames and the first bridge of the frame structure of FIG. 9 are separated from one another.

All of the first bridge illustrated in FIGS. 11 and 12 and the first bridge illustrated in FIGS. 13 to 15 belong to this embodiment, and hence, the same reference numeral as the first bridge illustrated in FIGS. 11 and 12 is used.

Referring to FIG. 16, the first bridge 1200 includes a first joining portion 1250 joined to the support frame 1100 and a second joining portion 1260 joined to each of the first and second sub shafts 1220 and 1230 and rotatably hinge-coupled with the first joining portion 1250.

Concretely, the first joining portion 1250 includes: a slot 1252 formed in a direction that the first and second sub shafts 1220 and 1230 are respectively rotated for inserting the second joining portion 1260 thereinto; and coupling holes 1254 respectively formed in upper and lower faces of the slot 1252.

The second joining portion 1260 includes: an insertion protrusion 1262 formed to be inserted into the slot 1252; and coupling protrusions 1264 formed on upper and lower faces of the insertion protrusion 1262 and inserted into the coupling holes 1254. Therefore, the first and second sub shafts 1220 and 1230 can respectively rotate on the basis of the coupling protrusions 1264 inserted into the coupling holes 1254.

As described above, the first bridges 1200 can narrow the interval between the support frames 1100 without being separated from the support frames 1100 through the structure that the first and second sub shafts 1220 and 1230 are inserted into the through hole 1212 of the main shaft 1210 and the structure that the second joining portion 1260 is hinge-coupled with the first joining portion 1250.

Accordingly, because the interval between the support frames 1100 is narrowed in a state where the first bridges 1200 are not separated, the entire volume of the frame structure is reduced, and hence, the frame structure according to the present invention can be easily transported from the storage site of the frame structure to a place where the stage 10 (in FIG. 1) is constructed. Therefore, like the embodiment described referring to FIGS. 2 to 8, the frame structure according to the present invention can reduce expenses by reducing the size of a vehicle necessary for transport and the number of workers.

In the meantime, the first joining portion 1250 of the first bridge 1200 may be separated from the support frame 1100. Concretely, the support frame 1100 includes a rail recess 1110 elongated in a longitudinal direction, and the first joining portion 1250 includes a rail-joining part 1256 joined to the rail recess 1110.

The structure that the rail-joining part 1256 is joined to the rail recess 1110 is equal to the structure illustrated in FIGS. 2 to 8, and hence, its detailed description will be omitted.

As described above, because the first bridge 1200 has the telescopic structure and the structure to be separated from the support frame 1100, a user can select a transport state to make transport easy as occasion demands.

Moreover, the support frame 110 may have a fixing recess (not shown) at a position of the rail recess 1110 to fix the rail-joining part 1256. The fixing recesses may be formed in the rail recess 1110 at regular intervals in such a way as to be viewed when the rail recess 1110 is viewed from the side.

Meanwhile, referring to FIGS. 9 and 10, the second bridge 1400 may be joined to the support frames 1100 at right angles to the support frames 1100 in a state where the interval between the support frames 110 is widened by the first bridge 1200.

Then, the widened state of the support frames 1100 is supported by the second bridge 1400, and hence, the frame structure may have a more stable structure when it is installed on the stage 10 (in FIG. 1). In this instance, for a more stable support structure, the second bridges 1400 may be connected between the support frames 1100 at regular intervals.

An end portion of the second bridge 1400 is rotatably hinge-coupled to one of the support frames 1100, and because it is the same as the connection structure of the first bridge 1200 connected to the support frames 1100, its detailed description will be omitted.

The other end portion of the second bridge 1400 has a structure that it is capable of being connected to and separated from one of the support frames 1100. Concretely, a support block 1410 for vertically supporting the support frame 110 is joined to the other end portion of the second bridge 1400, and the support frame 110 has a screw hole 1120 formed at a position where the support block 1410 is supported. A bolt 30 is fastened to the screw hole 1120 to thereby pressurize and fix the support block 1410. Differently from the above, the other end portion of the second bridge 1400 may be joined with the support frame 1100 by a hook or clamp structure.

Accordingly, the second bridge 1400 is vertically joined to the support frames 1100 to thereby provide a stable structure in the state where the interval between the support frames 1100 is widened. However, when the user wants to narrow the interval between the support frames 1100, the one end portion of the second bridge 1400 is separated from the support frame 1100, and then, the second bridge 1400 is laid on the basis of the other end portion of the second bridge 1400, so that the interval between the support frames 1100 can be narrowed.

In this instance, in order to prevent interference by neighboring first bridges 1200 or second bridges 1400 when the second bridge 1400 is laid on the basis of the end portion thereof, the second bridge 1400 may have a telescopic structure that is changed in length, and its detailed description will be omitted because the structure is similar to that of the first bridge 1200.

Furthermore, in order to reduce the volume of the frame structure further, the one end portion of the second bridge 1400 may have a structure capable of being joined to and separated from the support frame 1100, and because the structure is equal to the structure that the first joining portion 1250 of the first bridge 1200 is separated from the support frame 1100, its detailed description will be omitted.

Meanwhile, in order to automatically reduce and extend the length of the second bridge 1400, the second bridge 1400 may have first and second springs which are equal to the first and second springs 1222 and 1232 mounted in the through hole 1212 of the first bridge 1200.

As described above, because the support frames 1100 have the more stable structure through the second bridge 1400 vertically joined between the support frames 1100, it can minimize injuries of persons or damages of expensive equipment which may be happened when the support frames 1100 are destroyed.

In addition, because a plurality of the support rods (not shown) are mounted in the shape of the honeycomb inside each of the support frames 1100 in order to reinforce intensity, the frame structure 2000 can have a more stable structure. Therefore, in order to reinforce intensity, the first and second bridges 1200 and 1400 also may be formed in a mold type, namely, in a form that has pores therein.

In the meantime, in this embodiment, the first and second bridges 1200 and 1400 are all joined between the support frames 1100, but one of the first and second bridges 1200 and 1400 may be joined between the support frames 1100.

Moreover, it is described that the frame structure 2000 is installed on the stage 10 (in FIG. 1), but according to circumstances, the frame structure can be widely used also in bridge structures for construction work or civil engineering to fix at least two shaft-type frames parallel using the first bridges 1200 or the second bridges 1400.

Figure 17:
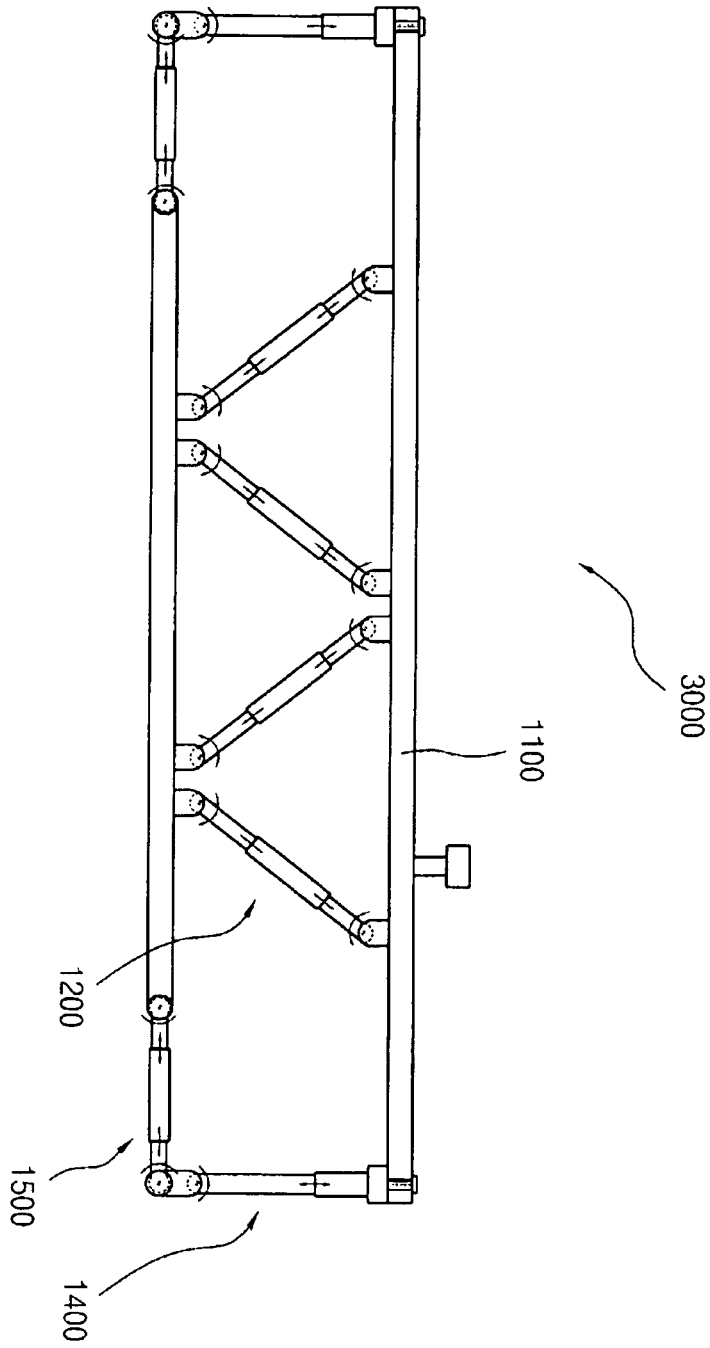
FIG. 17 is a view of a frame structure according to a further preferred embodiment of the present invention.

FIG. 17 is a view of a frame structure according to a further preferred embodiment of the present invention.

Except that an extension bridge is joined to the end portion of the support frame, this embodiment has the same structure as the embodiment illustrated in FIGS. 9 and 10, and hence, the same components have the same reference numerals and the repeated description will be omitted.

Referring to FIG. 17, the frame structure 3000 for stage erection according to this embodiment further includes at least one extension bridge 1500 joined to at least one end portion of the support frame 1100.

The extension bridge 1500 has the same structure as the first bridge 1200 illustrated in FIGS. 9 to 14, and hence, can be changed in length. Hereinafter, the detailed description of the extension bridge 1500 will be omitted because the extension bridge 1500 has the same structure as the first bridge 1200 illustrated in FIGS. 9 to 14. Furthermore, the extension bridge 1500 is rotatably hinge-coupled to the support frame 1100.

Accordingly, when the extension bridge 1500 is joined to the end portion of the support frame 1100 and the support frame 1100 having the extension bridge 1500 is connected with another neighboring support frame 1100, they can be connected with each other in an inclined structure and at an inclined angle through the hinge-coupled structure and the length-changeable structure.

Additionally, the second bridge 1400 may be hinge-coupled to an end portion of the extension bridge 1500. In this instance, the neighboring support frames 1100 can be inclinedly connected relative to the second bridge 1200.

In the meantime, it is described that the frame structures 1000, 2000 and 3000 are installed on the stage 10 (in FIG. 1), but according to circumstances, they can be used also in truss structures for construction work or civil engineering to fix at least two shaft-type frames parallel.

Industrial Applicability

As described above, the frame structure for stage erection according to the present invention is used to install supplementary installations, such as lights and billboards, in various places for progressing various events or performances, such as theaters, auditoriums, concert halls or exhibition halls, and can reduce transporting expenses because the support frames and bridges are transported in a separated state or a collapsed state.

While the present invention has been particularly shown and described with reference to the example embodiments thereof, it will be understood by those of ordinary skill in the art that various changes in form and details may be made therein without departing from the technical idea or technical scope of the present invention as defined by the following claims.

The invention claimed is:

1. a frame structure for stage erection comprising:

a plurality of support frames disposed parallel to each other, each of the support frames having a rail recess formed in a length direction at a portion where they are opposed to each other; and a plurality of bridges being connected between the support frames to keep the parallel state of the support frames, each of the bridges having a rail-joining part which is formed on at least one of both end portions thereof and is joined to or separated from the rail recess;

wherein the rail recess has an inner width greater than that of an entrance where the support frames are opposed to each other, and the rail-joining part has a retaining portion inserted into the rail recess to be caught to the entrance.

2. The frame structure according to claim 1, wherein each of the support frames has a fixing hole formed at a predetermined position of the rail recess to fix the retaining portion.

3. The frame structure according to claim 2, wherein each of the support frames has a guide portion formed at the entrance where the fixing hole of the rail recess is formed for guiding a position of the fixing hole.

4. The frame structure according to claim 3, wherein the guide portion is stepped down from its periphery at the entrance where the fixing hole is formed.

5. The frame structure according to claim 2, further comprising a fixing member inserted into the fixing hole for fixing the retaining portion.

6. The frame structure according to claim 5, wherein the fixing member comprises a bolt which is inserted into the fixing hole from a position of the fixing hole opposed to the retaining portion to pressurize the first retaining portion or is removed from the fixing hole.

7. The frame structure according to claim 5, wherein the fixing member comprises a fixture inserted into the fixing hole by elasticity of an elastic body, which is inserted into a portion of the retaining portion opposed to the fixing hole in order to provide elasticity to a direction of the fixing hole.

8. The frame structure according to claim 7, further comprising a separation member for pushing the fixture at a position of the fixture opposed to the retaining portion to thereby separate the fixture from the fixing hole.

9. The frame structure according to claim 1, wherein the bridge further comprises a body part hinge-coupled with the rail-joining part between the support frames; wherein the body part has a telescopic structure to change the length of the body part when an interval between the support frames is changed and comprises a fixing part disposed at a length-changeable portion in order to fix the longest state or the shortest state.

10. The frame structure according to claim 9, wherein the body part comprises:

a main shaft having a through hole in the middle thereof;

first and second sub shafts inserted into the through hole from both end portions of the main shaft in a length-adjustable manner, each of the first and second sub shafts having a rail-joining part; and first and second springs disposed inside the through hole for providing elasticity between the main shaft and the first and second sub shafts.

11. The frame structure according to claim 9, further comprising a lever mounted on at least one of the support frames to release the fixing part.

12. The frame structure according to claim 1, further comprising an extension bridge hinge-coupled to at least one end portion of the support frames.

13. The frame structure according to claim 12, wherein the extension bridge has a telescopic structure in such a way as to be changed in length.

14. A frame structure for stage erection comprising:

a plurality of support frames disposed parallel to each other; and a plurality of bridges having a hinge-coupling structure at both end portions thereof and being joined to connect the support frames with each other, each of the bridges having a telescopic structure to change the length of the bridge when an interval between the support frames is changed, wherein the bridge comprises a fixing part disposed at a length-changeable portion in order to fix the longest state or the shortest state.

15. The frame structure according to claim 14, further comprising a lever mounted on at least one of the support frames to release the fixing part.

16. The frame structure according to claim 14, wherein the bridge comprises:

a main shaft having a through hole in the middle thereof;

first and second sub shafts inserted into the through hole from both end portions of the main shaft in a length-adjustable manner, the first and second sub shafts being respectively joined to the support frames; and first and second springs disposed inside the through hole for providing elasticity between the main shaft and the first and second sub shafts.

17. The frame structure according to claim 14, further comprising a second bridge connected between the support frames, the second bridge being hinge-coupled to one of the support frames and having a structure to be joined to and separated from another one of the support frames.

18. The frame structure according to claim 17, wherein the second bridge has a telescopic structure to change the length, is joined between the support frames in an inclined state, and joined perpendicularly to the support frames in the longest state.

19. The frame structure according to claim 14, further comprising an extension bridge hinge-coupled to at least one end portion of the support frames.

20. The frame structure according to claim 19, wherein the extension bridge has a telescopic structure to change the length.

* * * * *